US006725616B1

(12) United States Patent
Pease

(10) Patent No.: US 6,725,616 B1
(45) Date of Patent: Apr. 27, 2004

(54) INSULATED CONCRETE WALL SYSTEM AND METHOD FOR ITS MANUFACTURE

(75) Inventor: Tyler E. Pease, Plymouth, WI (US)

(73) Assignee: Plymouth Foam Incorporated, Plymouth, WI (US)

( * ) Notice: Subject to any disclaimer, the term of this patent is extended or adjusted under 35 U.S.C. 154(b) by 0 days.

(21) Appl. No.: 09/649,687

(22) Filed: Aug. 28, 2000

(51) Int. Cl.[7] ..... E04B 1/74; E04B 2/30; E04B 2/40

(52) U.S. Cl. ..... 52/309.7; 309/309.12; 309/404.2; 309/410; 309/506.05

(58) Field of Search ..... 52/506.05, 511, 52/404.2, 408, 410, 794.1, 801.11, 364, 309.16, 309.14, 309.12, 309.9, 309.7, 309.8

(56) References Cited

U.S. PATENT DOCUMENTS

| | | | | |
|---|---|---|---|---|
| 3,313,073 A | | 4/1967 | Mathews | |
| 3,401,494 A | | 9/1968 | Anderson | |
| 3,484,331 A | | 12/1969 | Betz | |
| 3,525,189 A | * | 8/1970 | Nelsson | |
| 4,438,611 A | * | 3/1984 | Bryant | 52/309.2 |
| 4,455,794 A | * | 6/1984 | MacKinnon, Jr. et al. | 52/410 X |
| 4,653,246 A | | 3/1987 | Hepler | |
| 4,841,710 A | | 6/1989 | Considine | |
| 4,961,298 A | | 10/1990 | Nogradi | |
| 5,063,722 A | * | 11/1991 | Hohmann | 52/410 |
| 5,279,089 A | | 1/1994 | Gulur | |
| 5,333,429 A | | 8/1994 | Cretti | |
| 5,758,464 A | | 6/1998 | Hatton | |
| 5,799,462 A | | 9/1998 | McKinney | |
| 5,842,276 A | | 12/1998 | Asher et al. | |
| 5,893,248 A | | 4/1999 | Beliveau | |
| 6,408,594 B1 | * | 6/2002 | Porter | 52/794.1 |

OTHER PUBLICATIONS

Gold–Wall Insulating System, Plymouth Foam Incorporated, Brochure (2 sided).

* cited by examiner

*Primary Examiner*—Robert Canfield
(74) *Attorney, Agent, or Firm*—Reinhart Boerner Van Deuren s.c.

(57) ABSTRACT

An insulated wall system includes a concrete wall, either cast or built up with blocks, to which is attached several insulated panels, each of the insulated panels having reinforcing strips placed in recesses of the panel that extend the length of the panel. A reinforcing layer is provided on the outer surface of the panels that extends across the top of the recess and across the top of the reinforcing strips. This layer provides a vapor barrier, and is sealed between the fasteners and the reinforcing strips when the panels are attached to the concrete wall. The wall system is constructed by making the concrete wall, then attaching each of the insulated panels to the wall by fasteners that penetrate the reinforcing strips and are embedded in the wall. The wall system may also include another outer layer of wallboard that is mounted to the reinforcing strips, but preferably not to the wall itself. This wallboard preferably has the same planar dimensions (although not the same thickness) as the insulated panels and is mounted in a staggered relationship to the insulated panels. The wallboard is preferably staggered so that opposing edges of the wallboard are fastened to the reinforcing strips of the insulated panels. Since the reinforcing strips are preferably not located at the edges of the insulated panels, this will result in the wallboards being offset from the insulated panels, and also in their being attached to two or more insulated panels at the same time.

25 Claims, 2 Drawing Sheets

FIG. 2
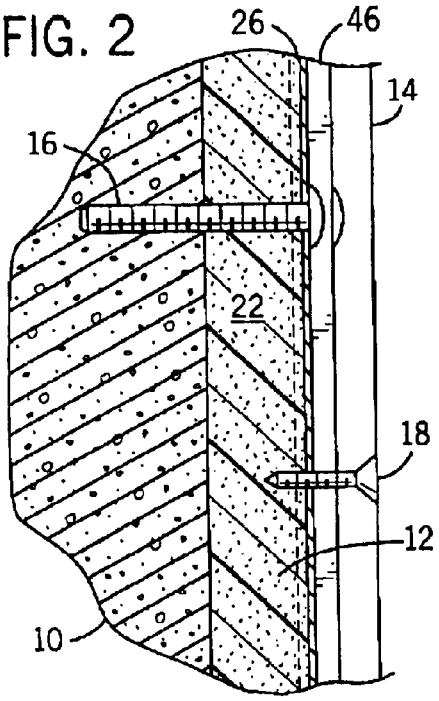
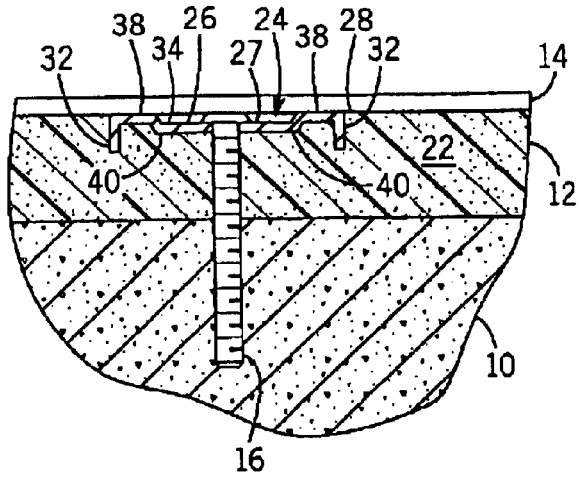
FIG. 3
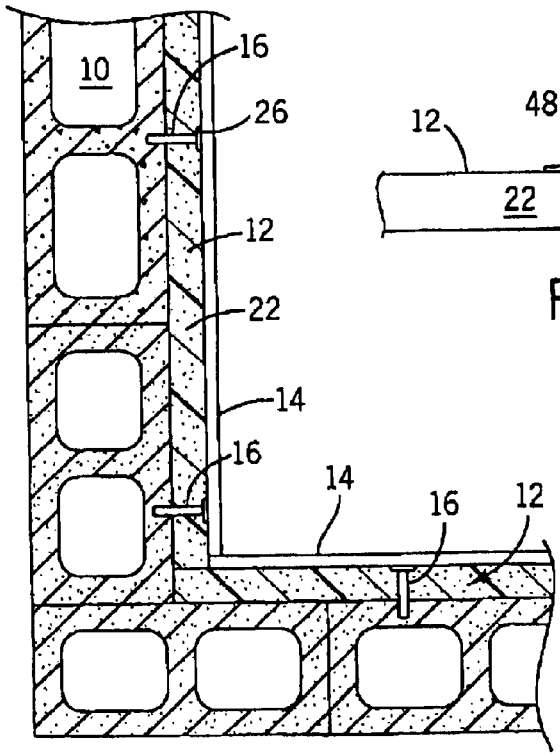
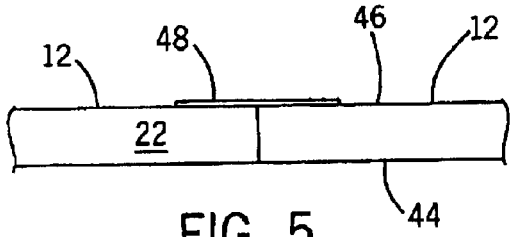
FIG. 5
FIG. 4

INSULATED CONCRETE WALL SYSTEM AND METHOD FOR ITS MANUFACTURE

FIELD OF THE INVENTION

The invention relates to the construction of concrete walls. More particularly, it relates to the construction of multi-layer concrete walls having a layer of concrete and a layer of insulation.

BACKGROUND OF THE INVENTION

Over the last thirty years, as fuel prices have increased, it has become more and more important to develop concrete wall systems with sufficient insulation characteristics. Many of the previous methods tried have been unsatisfactory. For example, some of the original attempts to build insulated concrete walls used sheets of rigid foam that were held to the surface of the concrete by construction adhesives. These sheets were time-consuming and difficult to attach, since they required a user to apply a liquid adhesive on the back of the panel, then hold it up against the wall, pressing it against the wall until it adhered firmly and the adhesive set.

To avoid these problems, other manufacturers devised insulated concrete wall systems that used mechanical fasteners to hold the foam against the wall. The drawbacks of this system were that the mechanical fasteners abutted the foam panels themselves and were attached to the concrete wall itself. As a result, a substantial force had to be applied to the fastener to get it to grip the concrete wall. If the fastener tilted to one side, or wandered, it would shred the foam paneling and leave a gap where air, moisture or water vapor could escape. In addition, if the installer pressed too hard on the fastener, it could penetrate the foam completely, rather than stop just below the surface of the foam. If the fastener was driven with too light a touch, it would protrude outward from the foam paneling and leave a "lump" against which subsequently attached wall coverings, such as gypsum board, would not rest smoothly.

In an attempt to eliminate some of these problems, some tried to place large washers under the heads of the fasteners to more evenly distribute the load against the foam paneling. While this seemed to reduce the damage initially, many applicators found they often drilled too deeply, causing the washers and strips to pucker and buckle outward away from the foam paneling as the center portion of the strips and washers were pulled into the outer layers of the foam. Further complicating these efforts was the need to simultaneously (1) hold the wall board up against the concrete wall, (2) locate the proper position to install the fastener, (3) position the washer, (4) insert the fastener through the washer, and (5) drive the fastener into the wall while simultaneously holding the automatic fastener driving machine, the fastener, the washer, and the paneling in the proper orientation.

As a further complication, most insulated concrete wall systems apply foam paneling to the inside wall surface and must be subsequently "finished" with an inner layer of wallboard, such as gypsum board, which can be taped and painted, or can be covered with wall "paper" or similar materials. Wallboard is typically attached to the concrete wall by attaching furring strips to the wall itself and filling the gaps between the strips with rigid foam sheet trimmed especially to fill the gaps and then attaching the wall board to the furring strips.

In addition, it is often necessary to attach a vapor barrier to the outer surface of the foam paneling to block vapor migration through the semi-permeable foam paneling and into the wallboard. This too requires the separate and independent steps of cutting a sheet of vapor barrier, unfolding it, raising it (typically with the assistance of at least two people, locating a desired attachment point through the vapor barrier, and attaching the vapor barrier with a series of fasteners to the foam paneling. Due to it floppy nature, it is virtually impossible to use an adhesive to attach the vapor barrier to the foam paneling directly, once the paneling has been installed.

All the above points to one major problem: the construction of insulated wall systems, whether interior or exterior, is a time consuming and labor intensive process. It is one of the purposes of this invention to reduce the time and labor involved in making insulated wall systems.

SUMMARY OF THE INVENTION

In accordance with a first embodiment of the invention, an insulated wall system is provided that includes a concrete wall, an insulated layer fixed to the concrete wall and comprising a plurality of insulated panels disposed adjacent to each other, each of the panels comprising a core of rigid foam, the foam having at least two reinforcing strips extending substantially the entire length of the panel, and a plurality of fasteners to retain the insulated panels to the concrete wall, wherein the fasteners have a shank, and the shank extends through the insulated panel into the wall where it is anchored. It may also include a wallboard layer fixed to the reinforcing strips of the insulated layer. A first reinforcing layer may be bonded to a first planar surface of the core of its corresponding panel and is disposed between the wallboard and the core. Each of the insulated panels of the wall system may include a second reinforcing layer bonded to a second planar surface of the core that opposes the first planar surface and is disposed between the concrete wall and the core. Each of two adjacent and substantially abutting panels may have a first reinforcing layer that extends substantially to the edge of two substantially abutting edges of the two substantially abutting panels, respectively, and may further include a self-adhesive plastic strip that bridges a joint defined by two closely adjacent edges of two adjacent insulated panels that is fixed to adjacent first reinforcing layers to join the two first reinforcing layers and form a water-resistant joint therebetween. The wall system may further include a second reinforcing layer disposed between the insulating layer and the concrete wall and fixed to the surface of the insulating layer. The at least two reinforcing strips of each panel comprising the insulating layer may be substantially parallel to each other and to two opposing edges of each of the panels, and further the plurality of fasteners may extend from an outer surface of the panels, through the first reinforcing layer, then through the reinforcing strips, and then through the core and then into the concrete wall where the plurality of fasteners are anchored. The wallboard layer may include a plurality of wallboards, and each of the wallboards may have substantially the same length and width as the insulated panels of the insulated layer. The plurality of wallboards may be fixed to the strips of the insulated panels such that each of the plurality of wallboards is attached to more than one insulated panel and each of the insulated panels is attached to more than one wallboard. A first lateral edge of a first of the plurality of wall boards may be fastened to one of the at least two reinforcing strips of a first insulated panel by a first plurality of second fasteners that extend through the first lateral edge and thence through the one of the at least two reinforcing strips of the first insulated panel and thence into the core of the first insulated panel. A second lateral edge of the first of the plurality of wallboards may be substantially parallel to the first lateral edge and be fastened to a corresponding one of the at least two reinforcing strips of a second insulated panel by a second plurality of second fasteners that extend through the second lateral edge and through the one of the at least two reinforcing strips of the second insulated panel and thence into the core of the second insulated panel.

In accordance with a second embodiment of the invention, a method of making an insulated wall system that includes a planar concrete wall having an insulated panel facing surface, an insulated layer comprising a plurality of planar insulated panels wherein each of the panels has a substantially planar wall-facing inner surface and an opposing and substantially planar outer surface that faces away from the wall and further wherein each of the panels comprises a core of rigid foam having at least two reinforcing strips extending substantially the entire length of the panel, and a plurality of fasteners that retain the insulated panels to the concrete wall is provided, where the method includes the steps of forming the concrete wall, orienting each of the plurality insulated panels with respect to the wall such that they abut each other at opposing lateral edges of each of the insulated panels and contact the wall, fastening each of the plurality of insulated panels to the wall with the plurality of fasteners such that the inner surfaces of the plurality of insulated panels are parallel to the insulated panel facing surface defined by the concrete wall, such that an inner plane defined by the wall facing surfaces of the plurality of insulated panels is parallel to the panel facing surface defined by the concrete wall, such that the wall facing surfaces of the plurality of insulated panels are substantially coplanar with each other, and such that a plane defined by the outer surfaces of the plurality of insulated panels are substantially coplanar. The wall system may further include a plurality of wallboards having a substantially planar inner panel facing surface and a substantially planar opposing facing outer surface, and a second plurality of fasteners that retain the plurality of wallboards to the plurality of insulated panels, where the method further includes the steps of orienting each of the plurality of wallboards with respect to the wall such that they abut each other at opposing lateral edges of each of the plurality of wallboard and contact the plurality of insulated panels, and fastening the plurality of wallboards to the plurality of insulated panels with the second plurality of fasteners. The step of fastening may include the steps of driving the plurality of fasteners through the at least two reinforcing strips, driving the plurality of fasteners through the cores of the plurality of insulated panels, and embedding a shank of each of the plurality of drive fasteners into the concrete wall. Each of the insulated panels may include a first reinforcing layer fixed to the outer surface of its respective panel wherein the first reinforcing layer extends across a top surface of one of the at least two reinforcing strips. The method may further include the steps of driving the plurality of fasteners through the first reinforcing layer prior to the step of driving the plurality of fasteners through the at least two reinforcing strips, and the step of compressing the first reinforcing layer between the fastener and the at least two reinforcing strips. The step of fastening the plurality of wallboards to the plurality of insulated panels may include the step of driving the second plurality of fasteners through the at least two reinforcing strips to a depth that does not cause the second plurality of fasteners to contact the outer surface of the concrete wall. The method may also include the step of driving the plurality of fasteners through the at least two reinforcing strips and into the concrete wall.

BRIEF DESCRIPTION OF THE DRAWINGS

FIG. 2 is a fragmentary cross-section of the wall system of FIG. 1, taken at section line 2—2 in FIG. 1 and showing the fasteners that hold the insulated panels to the wall, and the fasteners that hold the wallboard to the insulated panel;

FIG. 3 is a fragmentary cross-sectional view of the wall system of FIGS. 1 and 2 taken at section line 3—3 in FIG. 1 showing a cross section of the reinforcing strip that extends from the top to the bottom of the insulated panels together with a fastener that holds the reinforcing strip, and hence the insulated panel to the wall;

FIG. 4 is a fragmentary cross-sectional view of the comer of the wall system of FIGS. 1–3 taken at section line 3—3 in FIG. 1 showing the arrangement of concrete blocks in the wall, the insulated panels overlaying the concrete wall, and the wallboard overlaying the panel; and FIG. 5 is a bottom view of the wall system viewed from viewing lines 5—5 in FIG. 1 and showing two abutting insulated panels and the adhesive strip that joins their outer reinforcing layers.

DETAILED DESCRIPTION OF THE PREFERRED EMBODIMENTS

Figure 1:
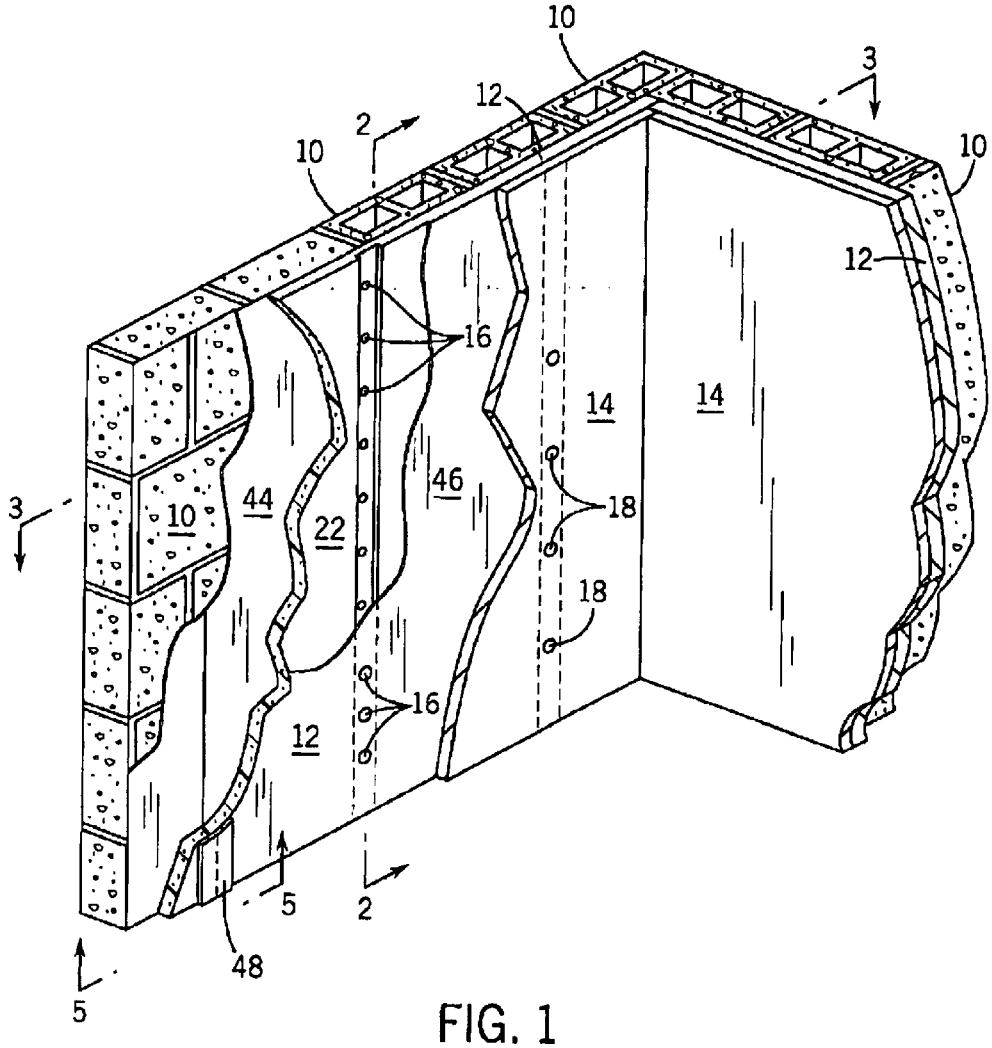
FIG. 1 shows a perspective view of a preferred embodiment of the insulated wall system with its various layers peeled off.

FIG. 1 illustrates a complete insulated wall 10 system having as many optional elements as possible. A structural wall 10, preferably concrete as shown here, is fixed to a layer of insulated panels 12 on which is mounted a wallboard layer of wallboards 14.

Wall 10 is preferably concrete, either cast in place, or assembled from hollow or solid concrete blocks. Insulated panels 12 are attached to wall 10 using fasteners 16, which pass through the insulated panels 12 and into wall 10 to which they are anchored. Wallboards 14, in turn are attached to insulated panels 12 by fasteners 18, which pass through wallboards 14 and into insulated panels 12 to which they are anchored.

Insulated panels 12 are of a multiple-layer construction. The core of insulated panels 12 is an insulating core 22 formed of a rigid foam such as polystyrene, polyurethane or polyisocyanurate, for example. Core 22 is preferably a closed-cell foam that includes many gas-filled bubbles of miniscule size that give core 22 an insulation value of at least R-3 for each inch of thickness.

Core 22 preferably has a thickness of between 0.50 and 2.50 inches, more preferably a thickness of between 0.75 and 2.00 inches and most preferably between 1.00 and 1.50 inches. The core 22 is preferably rectangular in cross-section, with nominal dimensions of 4 feet by 8 feet or 4 by 9 feet for vertical installation (i.e. when the greater dimension runs vertically) and 4 by 10 feet and 4 by 12 feet for horizontal installation (i.e. when the greater dimension runs horizontally). Other dimensions, of course, may also be used.

Core 22 has at least one, and preferably two or more longitudinal recesses 24 extending substantially parallel to two lateral edges of the panel. These edges are preferably the longer edges of 8 or 9 feet (or 10 or 12 feet when using longer panels horizontally installed). These recesses extend substantially the entire distance from one edge to the other opposing edge of the core, and are configured to receive a reinforcing or furring strip 26, discussed below.

In the preferred 4 by 8 foot embodiment, there are preferably two recesses, spaced two feet apart and disposed inwardly from the longitudinal edges of core 22 by a foot. There are several benefits to this arrangement. By providing two recesses spaced equidistantly from the lateral edges of the panel, the panels 12 are substantially symmetric about an axis passing through the center of the panel and parallel to either lateral edge. As a result, the panels define a strip-to-strip spacing of a constant two feet, or one half the width of the panel, when insulating panels 12 are arranged in an adjacent abutting relationship, as is preferred.

In many installations, however, a closer spacing of reinforcing strips may be desired, such as a 16-inch, 12-inch or 8-inch spacing.

The optimal 16 inch strip-to-strip spacing is provided by creating three recesses in the panel for receiving the strips with once recess extending the entire length of the core along a centerline of the core, with two adjacent parallel recesses, one disposed on either side of the central recess and spaced 16 inches away from the central recess. In this manner, three recesses (and hence the three strips disposed in the recesses) are disposed 16 inches apart. When the recesses are disposed in the core in this manner, an 8-inch width of core extends outwards on either side of the recesses for a total core width of 4 feet and similarly provides a constant spacing of 16 inches between recesses and strips when two or more panels are abutted against each other.

In a similar fashion, the recesses may be spaced on 12-inch centers, with 6 inches of free core extending outward from either side of the outermost cores. Again, this also provides a constant 12 spacing between recesses and strips when the panels are abutted against each other.

The recesses themselves have an average depth of between 0.125 and 1.250 inches. More preferably, they have an average depth of between 0.187 and 0.875 inches. Most preferably they have a depth of between 0.250 and 0.500 inches. The width of the recesses is preferably between 0.375 and 2.500 inches. More preferably, the width is between 0.625 and 2.000 inches. Most preferably, the width of the recesses is between 0.750 and 1.750 inches. The recesses in panel 12 extend substantially the entire length of the panel, or eight feet, in the 4 by 8 foot preferred embodiment, discussed above.

Reinforcing strips 26 are disposed in each of the recesses of the panel. Strips 26, when formed of a metal such as steel, preferably have an average thickness of between 16 and 30 gauge, and more preferably 20 and 28 gauge. The strips include a relatively wide and thin web 27 that extends generally parallel to planar surface 28 of core 22, and one or more stiffeners fixed to surface 26 and extending generally perpendicular to planar surface 28 of core 22. The preferred embodiment has two stiffeners, shown in the FIGURES as flanges 32 disposed on either side of web 27 and extending generally perpendicularly inward into core 22. They are fixed to and extend from either side of web 27. While this is the preferred arrangement, it should be understood that other arrangements of a web and stiffeners might be used. Web 27 and stiffeners preferably extend substantially the entire length of strips 26.

Web 27 includes a recessed central portion 34 extending generally parallel to the surface of panel 12. This recess permits typical headed fasteners 16 to be used to attach panel 12 to wall 10, while keeping the heads of fasteners 16 substantially below the surface of panel 12 when they have been screwed or nailed into wall 10. Since wallboards 14 are attached to the outer surface of panels 12, any significant extension of the heads of fasteners 16 above the surface of panel 12, would cause damage to the wallboards mounted on top of them and possibly cause the wallboards to rest on the heads and not make firm contact with the planar surface of panels 12. As a result, visual irregularities of the wallboard might show up when it is painted. Fasteners 16 can be inserted through pre-formed holes or slots in central portion 34, or can penetrate central portion 34 to make their own holes, depending upon the type of fastener and driving tool that is employed. If holes or slots are preformed in central portion 34, they are preferably formed at regular intervals along the length of strips 26, to permit fasteners inserted into the holes to be spaced between 12 and 24 inches apart.

Web 27 also includes two non-recessed portions 38 disposed on either side of the recessed portion and extending substantially parallel to the outer surface of panel 12. These non-recessed portions have an outer surface substantially coplanar with the outer surface of core 22. Portions 38 provide surfaces on which wallboard 14 can be supported. Two transition portions 40 are provided to join recessed central portion 34 to non-recessed portions 38.

There are preferably two additional layers to panel 12, an inner layer 44 disposed on the inside surface (the surface facing wall 10) of core 22, and an outer layer 46 disposed on the outer surface of core 22. These layers are preferably made of a polymeric film, foil, or a paper-like material or any combination thereof, and are bonded to the inner and outer surfaces of core 22. They preferably cover the entire inner and outer surfaces, and, in the case of the outer surface of core 22, pass over the top of, rather than underneath, strips 26. The layers preferably comprise polypropylene, polyethylene, or aluminum foil. Both layers preferably have a greater volumetric density and greater tensile strength than core 22, and thus reduce the possibility that panels 12 will be broken during shipping and handling, when lifted at the edges. The tensile strengths (e.g. pounds per square inch) of inner layer 44 and outer layer 46 are preferably at least two orders of magnitude (100 times) greater than that of core 22. More preferably, the tensile strengths (psi) of inner layer 44 and outer layer 46 are at least three orders of magnitude (1000 times) greater than that of core 22 thickness ½ mil to 12 mil. Their thicknesses, however should be significantly limited, due to their close spacing to the wall 10 and to the wallboard. The preferred thickness of the reinforcing layers is between 0.5 and 12 mils. More preferably it is between 1 and 8 mils. This additional strengthening is particularly significant given the structure of the panels. Since core 22 has a reduced thickness right where strips 26 are inserted into the recesses 24, flexing the panel could cause cores 22 to break right at the reduced thickness recess area. Any embodiment of the invention that uses the outer layer 46 extending across strips 26 and recesses 24 would reduce the chance that the panel will break at this critical spot. If panels 12 are flexed away from strips 26, the tension applied by the panel will be countered by the web of the outer layer extending across strips 26, and will reduce the possibility of panel breakage. In addition, the inner and outer layers each provide an additional vapor barrier that limits the passage of moist air or water through the panel.

Assuming an outer layer is employed in a particular embodiment of the invention, when fasteners 16 are inserted, they first pass through outer layer 46, through strips 26, and thence through core 22 and into wall 10, where they are anchored. The holes in outer layer 46 (through which fasteners 16 pass) are sealed between strip 26 and the heads of fasteners 16, thus reducing the flow of vapor and moisture through panels 12. An additional benefit to the presence of outer layer 46 is its cooperation with core 22 in holding strips 26 in place. Since outer layer 46 is preferably bonded to the outer surface of core 22, and preferably passes over the top of strips 26, it can retain strips 26 in place when panel 12 is lilted into position. While strips 26 may be mechanically held to core 22 by an interference fit, adhesives or heat welding for example, they might nonetheless be pulled loose from core 22 by rough handling, especially if core 22 is manually held at the edges of the panel parallel to strips 26 in a horizontal orientation with strips 26 facing downwardly.

Fasteners 16 are preferably threaded fasteners that are rotatably driven through panel 12 and into wall 10, although concrete nails may also be employed. Hand tools, such as a manual hammer or a manual screwdriver may be used to drive fasteners 16. However strips 26 are preferably of a thickness that permits automatic fastening devices such as electric or electric or pneumatic screwdrivers, electric or pneumatic hammers, or explosive powder actuated shot pin systems to be used.

Where moisture damage is a particular problem, the junction between abutting lateral edges of adjacent panels 12 can be sealed by applying an adhesive-coated strip of vapor barrier extending across the junction and attached to the adjacent and abutting edges of the outer surface of the two panels. This vapor barrier, shown in the FIGURES as plastic seam strip or tape 48, is applied to seal outer layer 46 up to adjacent panels 12 to each other. Outer layer 46 of the adjacent panels is preferably comprised of a water vapor-resistant polymeric film or layer having a texture that bonds readily to common construction adhesives. This points to another advantage of providing an outer layer 46 on core 22. Rigid foam materials, such as the preferred embodiment of core 22, adhere very poorly to standard adhesives applied at room temperature, as anyone who has tried to get common household adhesive tape to stick securely to non-skinned polystyrene foam knows. By bonding outer layer 46 on core 22, the system provides an outer surface to panel 12 that will bond readily to adhesive-coated polymeric vapor barriers, such as plastic strip 48. When plastic strips 48 are applied, the outer layers 46 are joined to provide a continuous vapor barrier that extends across several of panels 12 that are pierced only by fasteners 16. As we noted above, the holes that fasteners 16 make in outer layers 46 are sealed by compressing outer layers 46 between the heads of fasteners 16 and strips 26. Thus, in this embodiment, the insulated wall system provides a continuous vapor barrier that extends across a plurality of panels 12.

The system in its most complete embodiment includes a layer comprising several panels of wallboard 14. In common use in interior office or home applications, each wallboard 14 is typically "drywall" or gypsum board. Two of the critical problems with such wallboard is attaching it to a sufficiently level surface, and attaching it firmly to that surface so that no edge protrudes. Any protrusion will require additional "mudding", or coating of the outer surface of the wallboard, to disguise these irregularities. By preferably recessing the heads of fasteners 16 below the level of non-recessed portions 38, the wallboard can be supported on the non-recessed portions 38 without making contact with the heads of fasteners 16 sufficient to cause the heads of fasteners 16 to crack the wallboard. Preferably, fasteners 16 will have a head height selected such that the heads make no contact with the wallboard when the wallboard is fastened to strips 26. For wallboard material other than gypsum board or the like, that have a greater tensile strength, it may not be necessary to completely recess the heads of fasteners 16.

Installing wallboards 14 is relatively simple. Once panels are attached to wall 10 by fasteners 16, wallboards 14 can be lifted into place against the outer surface of panels 12 and fastened with fasteners 18 to strips 26. It is preferable to place the inside surfaces of wallboard 14 against the outer layer of panels 12 and against non-recessed portions 38 of strips 26. Since the outer surface of non-recessed portions 38 preferably lie in the same plane as the outer surface of outer layer 46, a smooth wallboard and will make contact with both outer layer 46 and non-recessed portions 38. Thus, wallboards 14 will rest against and be simultaneously supported by both non-recessed portions 38 and outer layer 46. Since outer layer 46 is also in contact with core 22, wallboards 14 will also rest against and be simultaneously supported by both non-recessed portions 38 and core 22. Thus, in this embodiment, when wallboards 14 are attached to panels 12, they are immediately adjacent to and abut a continuous vapor barrier that extends across a plurality of panels 12.

The insulated wall structure is preferably assembled as follows. First, a planar concrete wall 10 is created. It may be created by pouring a cement slurry between two preferably equidistantly-spaced forms that define an interior and an exterior surface of the wall 10 therebetween followed by the step of permitting the slurry to cure to concrete. Alternatively, the wall may be created by assembling a plurality of substantially identical concrete blocks, either solid or hollow, with a layer of wet mortar or cement slurry between adjacent blocks to create a wall preferably having and equidistantly spaced inner surface and outer surface, and permitting the mortar or slurry to cure.

Once wall 10 is created, each of panels 12 is individually and sequentially lifted into position such that the inner surface of panels 12 abuts a surface of wall 10. As each panel 12 is lifted into place against wall 10, two or more fasteners 16 are driven through strips 26 and into wall 10. This holds each panel 12 against wall 10. As each subsequent panel 12 is lifted into place against wall 10, it is preferably oriented such that an edge of the subsequent panel 12 is aligned with and abuts a corresponding and facing edge of similar length of a previous panel 12 already attached to concrete wall 10. As part of this alignment, the two aligned edges of the adjacent panels 12 are preferably spaced within one inch of each other. More preferably, they are spaced within a ⅜ of an inch of each other. Even more preferably, they are spaced to within 3/16 of an inch of each other. Most preferably, they physically abut each other such that substantially all of the area of the free edges (substantially the entire thickness) of the panels abut an adjacent panel. Once the subsequent panel 12 is placed in this position, a plurality of fasteners 16 is driven through strips 26 of the subsequent panel 12 to hold it in this position.\

The panels may be attached to the walls in wither a horizontal or a vertical orientation. In a horizontal orientation, the panels are arranged such that their greater length runs horizontally, and hence the strips run horizontally as well. When oriented in this fashion, the lowest panel—the one attached to the concrete wall and adjacent to the floor—is preferably attached to the wall first. Subsequent panels are then attached to the wall above the previous panel and in the same horizontal orientation, with their lower horizontal edges abutting the upper horizontal edges of the previously attached panel or panels.

In a vertical orientation, the panels are arranged such that their greater length runs vertically, and hence the strips run vertically as well. When oriented in this fashion, each panel is attached to the wall adjacent to each other, such that parallel rows of Once two adjacent panels are secured to wall 10 by fasteners 16, plastic seam strip or tape 48 can be applied to the abutting edges of the two panels to adhere to outer layer 46 of both panels to thereby provide a substantially vapor-resistant barrier that extends over the entire length of the abutting edges. Alternatively, three or more adjacent panels can be fixed to wall 10 by fasteners 16 before plastic strip 48 is applied to the abutting edges. Indeed, it may be preferable to fix all of panels 12 to wall 10 before sealing all the abutting edges of the panels with plastic strip 48.

Once at least two adjacent panels 12 are secured to the wall, the optional wallboard 14 can be attached to the panels that have been already hung. Each wallboard 14 is lifted into place such that its inner surface is closely adjacent to, and preferably abuts, the outer surface of panels 12. As each wallboard 14 is lifted into place against panels 12 it is preferably oriented such that the joint between the edges of adjacent wallboards 14 does not coincide with the joint between adjacent panels 12. More preferably, the edges of adjacent wallboards 14 abut each other in the center of strips 26. Since wallboards typically come in standard dimensions of four feet by eight feet (other lengths are common as well), and since strips 26 are spaced apart at 24-inch, 16-inch, 12-inch or 8-inch intervals (or any other even multiple of the width of the panel itself), each wallboard 14 will have both its outer edges supported by and attached to strips 26.

Strips 26 are preferably placed in the interior of panels 12, and are spaced away from the edges of panels 12, they are preferably attached to panels 12 by driving two or more fasteners 18 through the wallboard and into strips 26. In addition, to prevent flexure of the middle of wallboards 14, two or more additional fasteners 18 can be driven through the middle of wallboard 14 into strips 26 that extend along the middle of wallboard 14. Thus, two lateral opposing edges of wallboard 14 are supported on two different strips 26 of panels 12 that are positioned to extend along the length of the two lateral opposing edges of the wallboard. In addition, at least one additional strip 26 is positioned to extend substantially parallel to the two lateral opposing edges of wallboard 14 and between them. This would be the case whether the strips were spaced two feet apart, or even closer together such as 16 inches apart in each panel 12. With a 16 inch spacing between adjacent and parallel strips 26, a four by eight foot sheet of panel 12 would preferably have three 8 foot lengths of strips 26 spaced 16 inches apart, each of which being substantially parallel to the eight foot opposed lateral edges of panel 12 and disposed in the center of panel 12 such that the two outside strips 26 are each spaced 8 inches from the adjacent eight foot lateral edge of panel 12. This arrangement would place the center strip 26 of the three strips 26 along the centerline of panel 12, spaced two feet (equidistantly) from each of the opposed eight-foot lateral edges of panel 12.

With a narrower spacing, such as 12 inches between the parallel strips, the outermost strips would preferably be spaced away from each lateral edge of the panel by 6 inches. With an even narrower spacing, such as 8 inches, the outermost strips would be spaced away from each lateral edge of the panel by 4 inches.

It is preferable that fasteners 18—the fasteners that secure wallboards 14 to strips 26—do not extend all the way through panel 12. As fasteners 18 are driven, they first penetrate their corresponding wallboard 14, and then pass through outer layer 46 and into strips 26. The length of fasteners 18 is preferably selected such that they do not extend completely through core 22 and into wall 10 when their heads are substantially flush with the surface of wallboards 14 as shown in FIG. 2. The reason for this arrangement is to reduce the possibility of moisture leakage and vapor leakage from concrete wall along fastener 18 to the wallboard and heat transfer in the reverse direction from fastener 18 into the concrete wall. To further reduce the possibility of leakage and heat transfer, it is preferable that fasteners 18 are not inserted along the centerline of strips 26, but are inserted on either side of the centerline, and preferably into non-recessed portions 38. While the preferred method of attaching wallboard 14 is to attach it such that it overlaps two of panels 12, this is not essential. Thus, as soon as a single panel 12 is attached to wall 10, the builder could immediately attach a wallboard 14 to that single panel. Thus, the process of hanging panels 12 to wall 10 structure can be interleaved with the process of attaching wallboard 14 to those panels by attaching at least a first and second panel, then a wall board across those two, then a third panel, then an addition wallboard across the second and third panels, then a fourth panel, then a third wallboard across the third and fourth panel, etc. Once at least two or more wallboards 14 are attached to panels 12, the joints between adjacent wallboards can be sealed, mudded and finished with paint or some other liquid coating, if desired.

What is claimed is:

1. An insulated wall system, comprising:

a concrete wall;

an insulated layer fixed to the concrete wall and comprising a plurality of insulated panels disposed adjacent to each other, each of the panels comprising a core of rigid foam, and at least two reinforcing strips extending substantially the entire length of the panel;

a plurality of fasteners to retain the insulated panels to the concrete wall, wherein the fasteners have a shank, and the shank extends through the insulated panel and through the reinforcing strips and thence into the wall where it is anchored; and a wallboard layer fixed to the reinforcing strips of the insulated layer, wherein each of the insulated panels of the wall system further comprises a first reinforcing layer that is bonded to a first planar surface of the core of its corresponding panel and is disposed between the wallboard layer and the core, wherein the at least two reinforcing strips of each insulated panel comprising the insulating layer are substantially parallel to each other and to two opposing edges of each of the panels, and further wherein the plurality of fasteners are driven from an outer surface of the insulated panels, through the first reinforcing layer, then through the reinforcing strips, and then through the core and then into the concrete wall where the plurality of fasteners are anchored.

2. The insulated wall system of claim 1, wherein each of the insulated panels of the wall system further comprises a second reinforcing layer bonded to a second planar surface of the core opposite the first planar surface and is disposed between the concrete wall and the core.

3. The insulated wall system of claim 1, wherein each of two adjacent and substantially abutting panels have a first reinforcing layer that extends substantially to the edge of two substantially abutting edges of the two substantially abutting panels, respectively, and further comprising:

a self-adhesive plastic tape that bridges a joint defined by two closely adjacent edges of two adjacent insulated panels that is fixed to adjacent first reinforcing layers to join the two first reinforcing layers and form a vapor barrier joint therebetween.

4. The insulated wall system of claim 3, further comprising a second reinforcing layer disposed between the insulating layer and the concrete wall and bonded to the surface of the insulating layer.

5. An insulated wall system comprising:

a concrete wall;

an insulated layer fixed to the concrete wall and comprising a plurality of insulated panels disposed adjacent to each other, each of the panels comprising a core of rigid foam, and at least two reinforcing strips extending substantially the entire length of the panel wherein each panel further includes an outer layer of water vapor resistant polymeric film bonded to the outer surface of each core and further wherein each foam core defines at least two elongated recesses that receive the at least two reinforcing strips, and further wherein the polymeric film extends across the recesses and across the reinforcing strips disposed in the recesses;

a plurality of fasteners to retain the insulated panels to the concrete wall, wherein the fasteners have a shank, and the shank extends through the insulated panel and through the reinforcing strips and thence into the wall where it is anchored; and a wallboard layer fixed to the reinforcing strips of the insulated layer wherein the wallboard layer comprises a plurality of wallboards, and each of the wallboards has substantially the same length and width as the insulated panels of the insulated layer, and further wherein the plurality of wallboards are fixed to the strips of the insulated panels such that each of the plurality of wallboards is attached to more than one insulated panel, and each of the insulated panels is attached to more than one wallboard.

6. The insulated wall system of claim 5, wherein a first lateral edge of a first of the plurality of wall boards is fastened to one of the at least two reinforcing strips of a first insulated panel by a first plurality of second fasteners that extend through the first lateral edge and thence through the one of the at least two reinforcing strips of the first insulated panel and thence into the core of the first insulated panel, and further wherein a second lateral edge of the first of the plurality of wallboards that is substantially parallel to the first lateral edge is fastened to a corresponding one of the at least two reinforcing strips of a second insulated panel by a second plurality of second fasteners that extend through the second lateral edge and through the one of the at least two reinforcing strips of the second insulated panel and thence into the core of the second insulated panel.

7. A method of making an insulated wall system comprising a planar concrete wall having an insulated panel facing surface, an insulated layer comprising a plurality of planar insulated panels wherein each of the panels has a substantially planar wall-facing inner surface and an opposing and substantially planar outer surface that faces away from the wall and further wherein each of the panels comprises a core of rigid foam having at least two reinforcing strips extending substantially the entire length of the panel, and a plurality of fasteners that retain the insulated panels to the concrete wall, the method comprising the steps of:

forming the concrete wall;

orienting each of the plurality of insulated panels with respect to the wall such that they abut each other at opposing lateral edges of each of the insulated panels and contact the wall;

fastening each of the plurality of insulated panels to the wall with the plurality of fasteners such that the wall-facing surfaces of the plurality of insulated panels are parallel to the insulated panel facing surface defined by the concrete wall, such that an inner plane defined by the wall facing surfaces of the plurality of insulated panels is parallel to the panel facing surface defined by the concrete wall, such that the wall facing surfaces of the plurality of insulated panels are substantially coplanar with each other, and such that a plane defined by the outer surfaces of the plurality of insulated panels are substantially coplanar; wherein each of the insulated panels includes a first reinforcing layer bonded to the outer surface of its respective core and wherein the first reinforcing layer extends across a top surface of at least one of the at least two reinforcing strips; and wherein the method further includes the steps of:

driving the plurality of fasteners through the first reinforcing layer prior to the step of driving the plurality of fasteners through the at least two reinforcing strips; and compressing the first reinforcing layer between the fastener and the at least two reinforcing strips.

8. The method of making an insulated wall system of claim 7 that further comprises a plurality of wallboards having a substantially planar inner panel facing surface and a substantially planar opposing facing outer surface, and a second plurality of fasteners that retain the plurality of wallboards to the plurality of insulated panels, the method further comprising the step of:

orienting each of the plurality of wallboards with respect to the wall such that they abut each other at opposing lateral edges of each of the plurality of wallboards and contact the plurality of insulated panels; and fastening the plurality of wallboards to the plurality of insulated panels with the second plurality of fasteners.

9. The method of making an insulated wall system of claim 7 wherein the step of fastening includes the steps of:

driving the plurality of fasteners through the at least two reinforcing strips;

driving the plurality of fasteners through the cores of the plurality of insulated panels; and embedding a shank of each of the plurality of driven fasteners into the concrete wall.

10. The method of making an insulated wall system of claim 8, wherein the step of fastening the plurality of wallboards to the plurality of insulated panels includes the step of:

driving the second plurality of fasteners through the at least two reinforcing strips to a depth that does not cause the second plurality of fasteners to contact the outer surface of the concrete wall.

11. The method of making an insulated wall system of claim 10, further comprising the step of driving the plurality of fasteners through the at least two reinforcing strips and into the concrete wall.

12. An insulated wall system, comprising:

a concrete wall;

an insulated layer fixed to the concrete wall and comprising a plurality of insulated panels disposed adjacent to each other, each of the panels comprising a core of rigid foam, and at least two reinforcing strips extending substantially the entire length of the panel;

a plurality of fasteners to retain the insulated panels to the concrete wall, wherein the fasteners have a shank, and the shank extends through the insulated panel and through the reinforcing strips and thence into the wall where it is anchored, and wherein each panel further includes an outer layer of water vapor resistant polymeric film bonded to the outer surface of each foam core and further wherein each foam core defines at least two elongate recesses that are spaced equidistantly from opposing edges of the foam core that receive the two reinforcing strips, and further wherein the reinforcing strips are inserted within the recesses to a depth such that they are flush with the outer surface of said each foam core and further wherein the polymeric film extends across the recesses and across the reinforcing strips disposed in the recesses.

13. The insulated wall system of claim 12, wherein the tensile strength of the polymeric film is at least two orders of magnitude greater than the tensile strength of the foam core and further wherein the thickness of the polymeric film is between 0.5 and 12 mils, and further wherein the thickness of the foam core is between 0.5 and 2.5 inches.

14. The insulated wall system of claims 12, wherein the reinforcing strips include a central portion that extends the length of the strip and is recessed below the polymeric film to define a space therebetween.

15. The insulated wall system of claim 12, wherein the portion of the polymeric film extending across the top of the recesses and reinforcing strips is dimensioned to be placed in tension when the form core is flexed before the foam core fractures due to the flexing.

16. The insulated wall system of claim 12, wherein the two reinforcing strips are spaced a constant distance apart over their entire length, and further wherein the constant distance apart is twice the distance between each strip and its corresponding and adjacent edge of the foam core.

17. The insulated wall system of claim 16, wherein the constant distance is 16 inches, and the distance between each strip and its corresponding and adjacent edge is 8 inches.

18. A method of making an insulated wall system comprising a planar concrete wall having an insulated panel facing surface, an insulated layer comprising a plurality of planar insulated panels wherein each of the plurality of panels is remotely manufactured and comprises a core of rigid foam having at least two reinforcing strips extending substantially the entire length of the panel that are disposed in recesses in the foam core and an outer skin bonded to a surface of the foam core to enclose the reinforcing strips, the method comprising the steps of:

orienting the plurality of insulated panels with respect to the wall such that each of the plurality of panels abut one another at opposing lateral edges of said each of the plurality of panels and wherein each of the plurality of panels is in abutting contact with the wall; and inserting each of the plurality of fasteners first through the outer skin, then through the reinforcing strips and then into the concrete wall.

19. The method of claim 18, wherein the step of orienting at least two adjacent panels includes the step of orienting the reinforcing strips on a first panel and a second panel adjacent and abutting the first panel such that the distance between adjacent reinforcing strips on the first and second panel and the distance between adjacent reinforcing strips within the first panel and the distance between adjacent reinforcing strips within the second panel are the same.

20. The method of claim 21, wherein the distance between adjacent reinforcing strips on the first and second panel and the distance between adjacent reinforcing strips within the first panel and the distance between adjacent reinforcing strips within the second panel is at least 16 inches.

21. The method of claim 20, wherein the distance between adjacent reinforcing strips on the first and second panel and the distance between adjacent reinforcing strips within the first panel and the distance between adjacent reinforcing strips within the second panel is at least 12 inches.

22. An insulated wall system, comprising:

a concrete wall;

an insulated layer fixed to the concrete wall and comprising a plurality of insulated panels disposed adjacent to each other, each of the panels comprising a core of rigid foam, and at least two reinforcing strips extending substantially the entire length of the panel;

a plurality of fasteners to retain the insulated panels to the concrete wall, wherein the fasteners have a shank, and the shank extends through the insulated panel and through the reinforcing strips and thence into the wall where it is anchored, further comprising a reinforcing layer bonded to an outer surface of the core and extending from the outer surface to which it is bonded across the tops of the at least two reinforcing strips and back to the outer surface to which it is bonded.

23. An insulated wall system, comprising:

a concrete wall;

an insulated layer fixed to the concrete wall and comprising a plurality of insulated panels disposed adjacent to each other, each of the panels comprising a core of rigid foam, and at least two reinforcing strips extending substantially the entire length of the panel;

a plurality of fasteners to retain the insulated panels to the concrete wall, wherein the fasteners have a shank, and the shank extends through the insulated panel and through the reinforcing strips and thence into the wall where it is anchored; and a reinforcing layer extending across the tops of the at least two reinforcing strips, wherein the reinforcing layer has a tensile strength at least two orders of magnitude greater than the tensile strength of the foam core and further wherein the thickness of the reinforcing layer is between 0.5 and 12 mils, and further wherein the thickness of the foam core is between 0.5 and 2.5 inches.

24. The insulated wall system of claim 23, wherein the thickness of the reinforcing layer is between 0.5 and 12 mils, and further wherein the thickness of the foam core is between 0.5 and 2.5 inches.

25. The insulated wall system of claim 24, wherein the nominal length and width of the core is selected from the group consisting of 4 by 8, 4 by 9, 4 by 10 and 4 by 12 feet.

* * * * *